United States Patent [19]

Frör

[11] 4,445,288

[45] May 1, 1984

[54] SPORT SHOE WITH A STUDDED SOLE

[76] Inventor: Werner Frör, Schornbaumstrasse 5, D-8520 Erlangen, Fed. Rep. of Germany

[21] Appl. No.: 360,949

[22] Filed: Mar. 23, 1982

[30] Foreign Application Priority Data

Mar. 28, 1981 [DE] Fed. Rep. of Germany ..... 3112390

[51] Int. Cl.[3] ..... A43C 13/04; A43C 15/16

[52] U.S. Cl. ..... 36/134; 36/59 R; 36/61; 36/62; 36/65; 36/67 A; 36/67 D

[58] Field of Search ..... 36/59 R, 59 A, 59 B, 36/61, 62, 64, 66, 67 D, 124, 127, 134, 67 R, 67 A; 24/221 R, 221 A, 221 K; 411/349, 350; 403/348, 349

[56] References Cited

U.S. PATENT DOCUMENTS

| | | | |
|---|---|---|---|
| 1,978,186 | 10/1934 | Buchanan | 403/349 |
| 3,066,425 | 12/1962 | Koley | 36/127 |
| 3,267,593 | 8/1966 | Turner | 36/67 D |
| 3,559,310 | 2/1971 | Kiela | 36/134 |
| 4,361,353 | 11/1982 | Vinson | 403/348 |

FOREIGN PATENT DOCUMENTS

| | | | |
|---|---|---|---|
| 2543268 | 3/1977 | Fed. Rep. of Germany | 36/67 D |
| 3003643 | 8/1981 | Fed. Rep. of Germany | 36/134 |
| 2409023 | 7/1979 | France | 36/67 R |

*Primary Examiner*—Werner H. Schroeder
*Assistant Examiner*—Steven N. Meyers
*Attorney, Agent, or Firm*—Thomas R. Vigil

[57] ABSTRACT

The invention is with respect to fixing studs in the shoe soles. A sport shoe, as an example of the invention has pockets in its sole, into each of which the wider base plate at the end of a stud may be slipped and then locked in position tightly by a keeper washer with outward lock parts on its edge locking into grooves in the walls of the pocket like a bayonet-joint. For stopping the stud turning in its pocket it may have a hollow in its base locking onto an unround horn or the like on the floor of the pocket.

12 Claims, 10 Drawing Figures

SPORT SHOE WITH A STUDDED SOLE

BACKGROUND OF THE INVENTION

The present invention is with respect to a sport shoe having a sole with studs, each stud having a root part taken up in a round pocket in the sole, the pocket having an edge with inward locking parts for overlapping locking parts on the stud so that the stud may be fixed in position by turning it in relation to the sole.

Such a way of fixing studs has been used in the past, see German Offenlegungsschrift specification No. 2,543,268, in which the stud has outward locking parts with a bayonet-joint function at its back end so that it may be kept in position in a separate box-like structure bedded in the sole of the shoe and having grooves into which the locking parts may be screwed to give the bayonet-joint function. The stud has a guide cylinder running fittingly through a guide space in the box in the shoe sole. The guide cylinder and the locking parts are, in this case, used in place of otherwise normally used threaded pins on studs which are simply screwed into the sole, and the female thread of an otherwise normally used box-like structure or sleeve in the sole has its place taken by the smooth guide space and its grooves for the locking parts at its one end. For being able to take up strong bending or tilting forces acting on the stud and the box in the sole, the box and the parts of the stud noted have to be made of high-strength material, this somewhat increasing the weight of the sport shoe. On the other hand, the parts of the stud sticking out of the sole have to be strongly connected with the guide cylinder so that, when such parts become worn, the complete stud has to be changed for a new one. Furthermore, such studs are likely to become twisted so that the outer form of the stud has been made small, that is to say small in diameter, and the studs have to be made smooth so that such studs will be limited to a design like that of spikes.

SHORT OVERVIEW OF THE INVENTION AND FURTHER DISCUSSION OF SOME PRIOR ART

One purpose of the present invention is that of designing a bayonet-joint like a connection for a shoe stud which makes do without separate box-like structures in the sole and without locking parts fixed to the stud.

A further purpose or object of the invention is that of designing studs for shoes which, with respect to their parts sticking out from the shoe sole, are not limited with respect to size and form.

A still further purpose to be effected by the present invention is that of designing studs which may, if needed, be made in more than one part so that when part of the stud has become worn, such part may be simply taken off and changed for a new one.

For effecting such purposes and further purposes, in the invention, a pocket in the sole for the or each stud has an edge with inward locking parts for overlapping locking parts on a separate ring with a hole in the middle for locking a wider root part of the or each stud within the pocket, the wider root part of the stud being, in the normal position of the shoe, over the round ring or washer.

In this respect, to make clear how the invention is different to the prior art in some respects, attention may be given to U.S. Pat. No. 3,066,425 which is with respect to a shoe spike construction in which the spike is fixed in the sole of a sport shoe by an end part of the spike or stud being placed in a round pocket let into the sole of the shoe, the pocket having a groove in its wall near its outer end so that a split washer may be put into the pocket, after the plate-like end of the stud has been put therein, expansion of the washer then taking place as it is let go of so that it is taken up in the groove and keeps the plate-like end of the stud and the stud itself in place. For putting a stud in place and taking off this stud, the split washer is gripped in a known way using special-purpose pliers so that its radius is decreased and it may be put into the groove or taken therefrom. When it is in the groove, it is under the root part of the stud which is lockingly fixed in position by the washer. The washer may be corrugated in the circumferential direction so that the root part of the stud will be acted upon by a spring force all the time.

A shortcoming in this respect is, however, that the stud may be only taken out and a new one put in its place on using special pliers for the split washer. If a strong force is to be produced for keeping the stud in position by the split washer, then putting the washer in place is the cause of some trouble needing, as noted in most cases, special-purpose pliers, the putting of the split washer into the groove making it necessary for the washer to be bent elastically for producing the desired force on the stud. Furthermore, the split washer, if it is to be able to be pushed in radially by controlled forces, will only have a generally small face resting against the root or plate-like part of the stud. If the root part of the stud is to be so designed that there is no chance of its being bent and pulled out on use of the shoe, this part has to be made of metal, this giving a parallel increase in weight. The use of studs or calks with foot parts of soft material such as rubber or synthetic resin, in the form of polyurethane for example, is not possible if the studs are put on in this way, but on the other hand in the present invention such a design is quite possible and it is furthermore possible for the ring with the bayonet-joint function to be made of synthetic resin for keeping down the weight and the price of such studs. Lastly, pockets in the shoe sole used in U.S. Pat. No. 3,066,425 are downwardly open so that it is possible for earth to get onto the split washer, which will then be very much harder to take out again.

Further details of the invention are given in the claims at the end of the specification.

LIST OF FIGURES AND DETAILED ACCOUNT OF WORKING EXAMPLES OF THE INVENTION

Some working examples of the invention will be seen in the figures and will become clear from the account now to be given.

Figure 1:
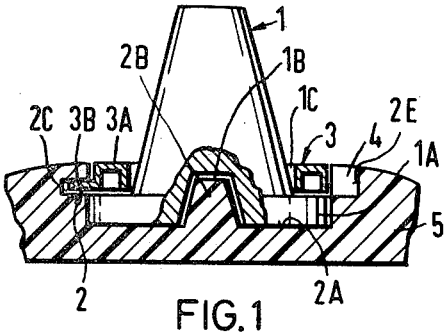
FIG. 1 is a diametral section on the line I—I of FIG. 2 through a stud of the present invention, which is fixed to the sole so that it may be taken off again.
Figure 2:
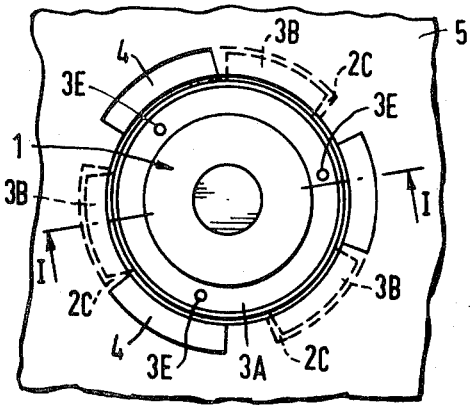
FIG. 2 is a plan view of the structure of FIG. 1.

Turning first to FIGS. 1 and 2, the reader will see that one of a number of studs 1 is fixed in a synthetic resin sole 5 of a sport shoe at one of a number of different points so that it may be taken off and exchanged for a new one as desired. The studs 1 themselves do not have any screws or the like for fixing them in position. In fact, pockets 2 of round form are present in the sole. Each pocket has grooves 2C cut recursively into the sidewall 2F of the pocket at some distance over the floor wall face 2A of the pocket. There are openings 4 (see FIG. 2) running down into the grooves 2C for the stiff bayonet-joint outward locking parts 3B of a separate locking washer 3 which, in the present example, is made of metal. The radially outward floors of grooves 2C are steplessly joined with such openings as will be seen on the right hand side of FIG. 1.

Figure 3:
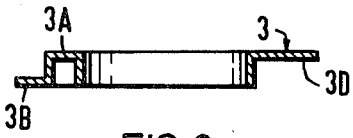
FIG. 3 is a diametral section on the line III—III of FIG. 4 through a keeper washer of the invention, made of drawn metal sheet.

Within the inner or circumferential wall 2F of pocket 2 the round base plate 1A of stud 1 is taken up so that it may not be twisted, twisting in fact being stopped by a middle, unround horn 2B on the bottom or floor wall 2A of pocket 2 which is taken up in an answering unround hollow 1B in the base plate 1A of the stud 1 when someone puts the stud 1 downwards into the pocket 2. The top part of the stud is a guiding part 1C running upwards from the base plate 1A and it may be cylindrical or coned and is placed within the keeper washer or locking washer 3. The keeper washer is, for this reason, rested on the uncovered, ring-like area of base plate 1A, outward stiff locking parts 3B round the edge of the keeper washer being taken up in locking grooves 2C after the keeper washer, with its outwardly running segment-like radial outward locking parts 3B has been screwed into the locking grooves 2C. Before the keeper washer is put in place, it is naturally necessary for its locking parts 3B to be lined up with the openings 4, then pushed inwards and then turned into its locking position. As will be seen from FIG. 3, the outward locking parts on keeper washer 3 are not in the same plane as its top face, but are bent outwards from the lower ends of downwardly bent wall parts of the ring. The lower side of the keeper washer, the downwardly facing top wall (or side wall) of the grooves (see FIG. 1) and/or the top side of the outward locking parts on the keeper washer and possibly as well the uncovered ring-like face of the keeper washer may be specially designed for stopping any twisting of the keeper washer so that the keeper washer, which, when the shoe is being used, will hardly be acted upon by twisting forces, is kept by an elastic force nonpositively, that is to say springingly or positively (that is to say lockingly) in contact with other parts of the stud fixing system and the stud itself. For pushing in and twisting the keeper washer, the same has small holes 3E on its top face 3A for a special-purpose key, other designs in addition to holes being possible.

Figure 4:
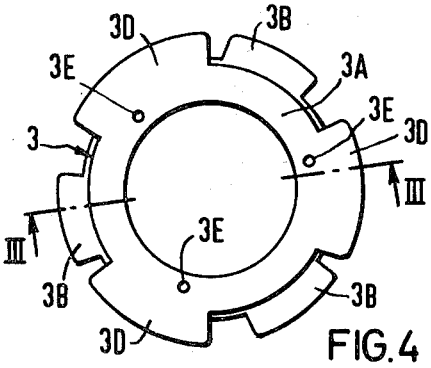
FIG. 4 is a plan view of the structure of FIG. 3.

In order to make certain that the keeper washer 3, once twisted home, may be readily freed by twisting for changing a stud 1, it is best for the openings 4 to be covered over, once the keeper washer 3 is screwed home, for stopping earth or the like getting into the pocket. To this end (see more specially FIGS. 3 and 4) the keeper washer 3 of metal has outwardly running stiff doors 3D of covers in the plane of the top 3A of the keeper washer. These doors 3D are, in the axial direction of the ring, lined up with the spaces between the outward locking parts 3B or lobes on keeper washer 3. In other words, doors 3D and locking parts 3B are circumferentially out of line with each other. Doors 3D may be in the form of upwardly and then outwardly bent parts, see FIG. 3.

In place of a metal keeper washer with stiff, hard outward locking parts and, possibly, stiff covers or doors, for the same pockets and studs, it is furthermore possible to make use of a lighter-weight solid-walled keeper washer of synthetic resin or plastic, if the outward locking parts take the form of radially running stiff locking nosepieces stretching in the length direction of the stud. In this case, the openings, through which the locking parts on the washer are put into position in the pocket (not figured) may be covered over by radially running covers molded givingly onto the top side of the keeper washers.

Figure 8:
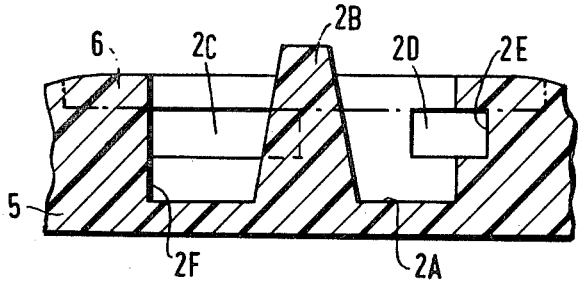
FIG. 8 is a diametral section on the line VIII—VIII of FIG. 9 through a pocket in the sole for studs and keeper washers as in FIG. 5 or FIG. 6.
Figure 9:
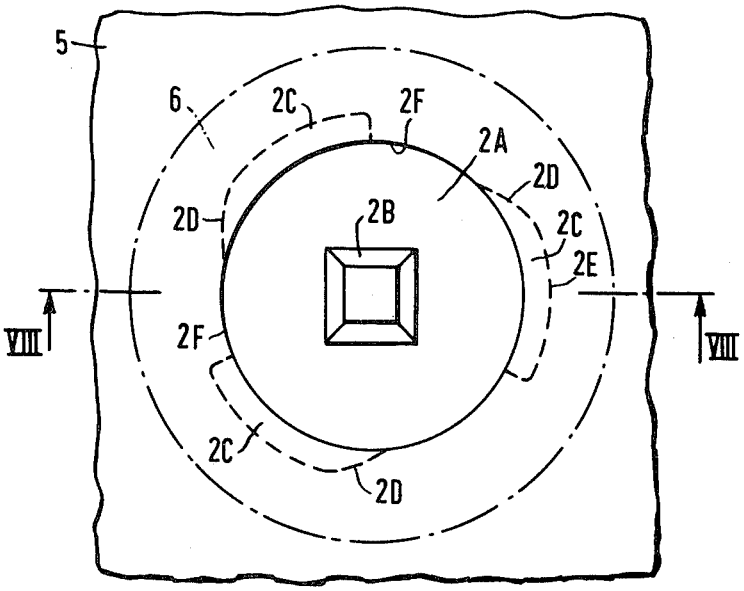
FIG. 9 is a plan view of the structure of FIG. 8.

Special openings for putting in the locking parts on the keeper washers and, for this reason, covering parts or doors are not necessary if the keeper washers used have outward locking parts in the form of locking nosepieces which may be bent springingly out of the way back as far as the outer edge of the keeper washer. It will be seen that in FIGS. 5, 6 and 7 the outward locking parts 3C, molded on the keeper washer as locking nosepieces, may be forced springingly inwards, on putting the keeper washer on top of the pocket 2 (see FIGS. 8 and 9) so that they are within the general outline of the keeper washer and the keeper washer 3 may be pushed into the pocket as far as the stud placed therein to give an elastic pre-loading effect on the stud. If the outward locking parts 3C, placed over the grooves 2C are not directly locked into them, but are over the inner wall 2F, the keeper washer is to be turned against a force by a key (which is put for the time being into the holes 3E) to be turned, after positioning within the pocket, till the outward locking parts have been completely twisted home into the grooves and are then able to undergo expansion in an outward direction so that the bayonet-joint with elastic pre-loading effect, will have been done up.

For undoing the keeper washer 3, the outer wall 2E of each locking groove 2C is joined up all the way round with the inner wall or face 2F so that on twisting the keeper washer 3 in the right direction, the springing outward locking parts 3C are pushed onto the inner face of the wall and, for this reason, out of the grooves so that, by pulling on the stud, the keeper washer itself may be taken from the pocket and, for this reason, taken off the sole.

To make it simpler for the keeper washer to be pushed home and taken off, the elastic locking nosepieces are cut into two pieces in the circumferential direction.

Because there is only a narrow ring-like space between the outer edge of the keeper washer 3 with the elastic outward locking parts and, on the other hand, the round inlet opening of the pocket 2, it is very unlikely that the locking washer will become stopped up with earth so that a cover is not necessary. However, such a cover would be possible on the lines noted earlier in the form of a cover on top of the keeper washer.

Figure 5:
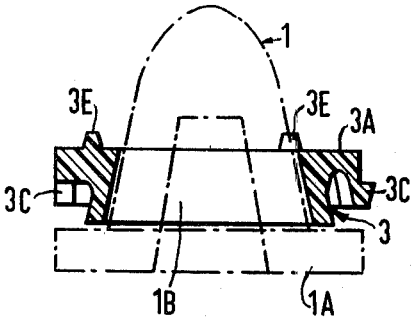
FIG. 5 and FIG. 6 are diametral sections on the line IV—IV in FIG. 7 taken through keeper washers made of synthetic resin, as part of the present invention.
Figure 6:
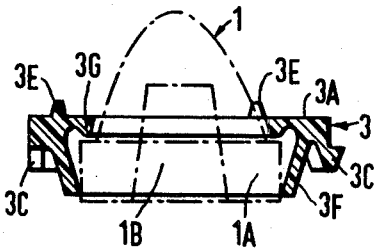
Figure 7:
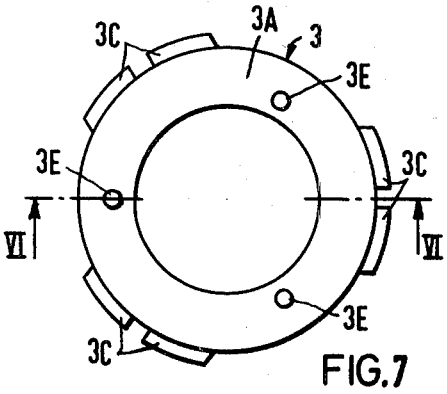
FIG. 7 is a plan view of the structure of FIG. 5 or FIG. 6.

The keeper washer with the elastic locking parts 3C as in FIG. 7 may have different forms of diametral cross-sections, see FIGS. 5 and 6. On having the same outline as in FIG. 7, the keeper washer 3 may be so designed for use with thicker soles 5 that its lower side is kept in position on the ring-like face of the base plate 1A of the stud 1, marked in broken lines, with a preloading or elastic effect, its inner wall resting tightly against the middle part 1C of stud 1 because of its form.

On the other hand, in the case of thinner soles, a better effect may be produced if the keeper washer of FIG. 6 is designed with a stiff middle ring 3F running at the side over the base plate 1A nearly as far as the floor face 2A of pocket 2, the support being by a lower inner lip 3G, centered on the center of the rest of the keeper washer and resting springingly on the ring area of the base plate 1A, this giving a useful effect more specially in the case of small studs. The inner ring 3G may be made with better spring properties if it has radial cuts in the circumferential direction.

The middle horn in the pocket 2 may furthermore be used, in addition to stopping the stud being turned, for supporting it in its part which is sticking out clear of the sole, the horn being made of a stiff piece of material of the right length for producing this effect. Possibly the horn will have the same form of its inner core as the outer form of the stud 1.

For the purpose of increasing the strength of the recursive parts even although the pockets 2 are simply made in the sole 5 itself, grooves 2C may be covered on their outside sides by a covering ring 6 of metal (see FIGS. 8 and 9) which is bedded in the sole material and/or joined with it in some known way to give a strong connection.

Figure 10:
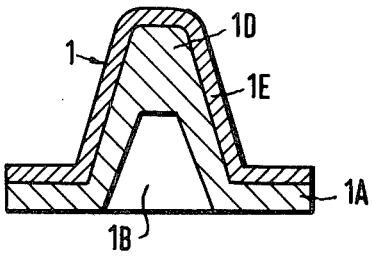
FIG. 10 is a diametral section through a two-layer stud of the present invention.

In the system of the invention for fixing studs in position using a sort of bayonet-joint, the studs themselves do not have to have any fastener or like parts thereon so that the parts of the studs outside the sole may have any desired form and/or size and, in some cases, may (see FIG. 10) be made in two layers, that is to say using a strong base part 1 D with a softer casing 1E which may be changed when worn, the two of them together being kept fixed in position by the keeper washer 3. In this respect, it is unimportant what the design of the studs is, for example as pointed spikes, studs as used on footballshoes, calkins or the like.

I claim:

1. In a short shoe having a sole with at least one pocket therein, a stud with a stud body in the form of an outward ground-gripping part, said stud being fixed to said sole by having a root part thereof infixed in said pocket, said root part having outward locking parts thereon to be overlapped by inward locking parts on an edge of said pocket, the invention residing in that said stud root is made up in two pieces, a base plate and a non-compressible, rigid keeper washer slipped onto said stud body and resting against a side of said base plate facing said stud body, said keeper washer having said outward locking parts thereon, which are taken up in grooves running next to said inward locking parts in a wall of said pocket, said keeper washer being designed for use with a key for turning its outward locking parts between a turned-home locked position, wherein they are locked and infixed by being overlapped by said inward locking parts, and a freed, uncovered position freeing said stud's base plate to take said stud out of said pocket.

2. A sport shoe as claimed in clam 1, wherein said pocket has a floor running generally parallel to a thread face of said hole, said pocket floor and a face of said base plate, facing in the opposite direction from said stud body, having structures for locking into each other and locking said stud, said stud is not able to be turned in said pocket.

3. A sport shoe as claimed in claim 1 or claim 2, wherein said keeper washer is made of metal with a round groove, opening out towards said base plate, therein, said outward locking parts being on a structure as an outer edge round said groove.

4. A sport shoe as claimed in claim 3, wherein said keeper washer has a side of it turned towards said body and at an outer edge thereof outward covers for covering up circumferential spaces between said inward locking parts on said pocket.

5. A sport shoe as claimed in claim 1, wherein said keeper washer has synthetic resin covers for covering up circumferential spaces between said inward locking parts on said pocket.

6. A sport shoe as claimed in claim 1, wherein said keeper washer is made of synthetic resin and has said outward locking parts thereon at an outer edge thereof, said locking parts being able to be pushed radially springingly inwards as far as an inner edge of said keeper washer.

7. A sport shoe as claimed in claim 6, wherein said outward locking parts are in the form of generally flat doors with radial cuts therein so that there is a division of each door into two parts.

8. A sport shoe as claimed in claim 6 or claim 7, wherein each said incut groove in said pocket wall is joined up by a sloping wall part with a wall face of said pocket having a smaller diameter than said groove.

9. A sport shoe as claimed in claim 1, claim 6 or claim 7, wherein said keeper washer has a stiff, middle ring, resting against the outer edge of the base plate and an inner lip, centered on the center of the rest of the ring and resting in the lower part against the base plate or the body of the stud, said body having the function of guiding said keeper washer.

10. A sport shoe as claimed in claim 1, wherein the grooves in the pocket are covered over by a cover ring joined with the sole.

11. A sport shoe as claimed in claim 2, wherein one of said locking structures is a male part and the other is a female part, the male part being fixed to the pocket and being designed as a support for the stud.

12. A sport shoe as claimed in claim 1, wherein said stud is made up of an inner strong support with the base plate, it being designed for guiding the keeper washer and lining the rest of the stud up in relation to the washer, and furthermore of a casing for covering the inner part of the stud up as far as the base plate, the casing being able to be taken off, the inner part of the stud together with the casing being kept in position and locked against twisting in relation to each other by the keeper washer.

* * * * *

UNITED STATES PATENT AND TRADEMARK OFFICE

CERTIFICATE OF CORRECTION

PATENT NO. : 4,445,288

DATED : May 1, 1984

INVENTOR(S) : WERNER FROR

It is certified that error appears in the above-identified patent and that said Letters Patent is hereby corrected as shown below:

Column 5, line 45 "short" should have been -- sport --.

Column 6, line 3 "clam" should have been -- claim --.

Signed and Sealed this

*Thirtieth* Day of *April 1985*

[SEAL]

*Attest:*

DONALD J. QUIGG

*Attesting Officer* *Acting Commissioner of Patents and Trademarks*